US005575327A

United States Patent [19]

Kato

[11] Patent Number: 5,575,327

[45] Date of Patent: Nov. 19, 1996

[54] STRIP CASTING APPARATUS

[75] Inventor: Heiji Kato, Yokosuka, Japan

[73] Assignees: Ishikawajima-Harima Heavy Industries Co., Ltd.; BHP Steel (JLA) Pty Ltd., both of Japan

[21] Appl. No.: 503,341

[22] Filed: Jul. 17, 1995

[30] Foreign Application Priority Data

Aug. 18, 1994 [AU] Australia ..... PM7508

[51] Int. Cl.[6] ..... B08B 1/04; B22D 11/06; B22D 43/00

[52] U.S. Cl. ..... 164/158; 164/428; 164/429; 15/256.51; 15/256.52; 15/256.53

[58] Field of Search ..... 164/480, 428, 164/479, 429, 423, 463, 158; 15/256.51, 256.52, 256.53

[56] References Cited

U.S. PATENT DOCUMENTS 4,793,400 12/1988 Wood ..... 164/429

*Primary Examiner*—Kuang Y. Lin
*Attorney, Agent, or Firm*—Nikaido, Marmelstein, Murray & Oram, LLP

[57] ABSTRACT

Apparatus for casting metal strip comprises casting rolls (12), metal delivery means (13, 14, 15, 16) into the nip (17) between the casting rolls (12) whereby to produce a cast metal strip (19). Roll cleaning brush devices (21) comprise brush head mounting structure (22) which carry linear arrays of rotary brush heads (20) applied to the outer sides of the casting rolls (12). The brush heads (20) of each device (21) are driven simultaneously through a gear train by a respective drive motor (35).

18 Claims, 4 Drawing Sheets

STRIP CASTING APPARATUS

TECHNICAL FIELD

This invention relates to metal strip casting apparatus in which molten metal is brought into contact with a casting roll surface so as to solidify on that surface. More specifically, it is concerned with continuous cleaning of the casting rolls in such casters.

The casting apparatus may be either a single roll caster or a twin roll caster. In a twin roll caster hot metal is introduced between a pair of contra-rotated horizontal casting rolls which are cooled so that metal shells solidify on the moving roll surfaces and are brought together at the nip between them to produce a solidified strip product at the outlet from the roll nip. The term "nip" is used herein to refer to the general region at which the rolls are closest together. The hot metal may be introduced into the nip between the rolls via a tundish and a metal delivery nozzle located beneath the tundish so as to receive a flow of metal from the tundish and to direct it into the nip between the rolls.

In order to prevent accumulation of metal oxides and slags or other contaminants on the roll surfaces, cleaning devices such as brushes or cleaning belts may be applied to the outer longitudinal sides of the rolls so that the roll surfaces are continuously cleaned before moving into contact with the molten metal in advance of the nip. One apparatus of this kind is disclosed in Japanese Patent Publication JO3230849-A of Nippon Steel Corporation and Mitsubishi Heavy Industries KK. In this apparatus two sets of divided roller brushes are applied to the peripheral surface of each chilled casting roll with the brushes of one set being staggered with respect to those of the other set to provide a brushing action across the complete width of the casting roll. Japanese Patent Publication J63207450-8 also of Nippon Steel Corporation and Mitsubishi Heavy Industries KK also discloses a twin roll caster in which the casting rollers are cleaned by roller brushes.

Problems in maintaining adequate contact between cleaning roller brushes or belts and the chilled casting rollers can arise due to thermal expansion and contraction of the rolls during the casting process which can result in a change to the shape of the roll surface. More particularly, an initially cylindrical roll may become non-cylindrical so as to have a concave curvature or alternatively a convex or hogged configuration. The result is that the cleaner cannot be applied to the roll with even pressure throughout its length and may even lose contact with some parts of the roll surface leading to an impaired cleaning action. Our U.S. Pat. No. 5,307,861 disclosed an improved roll cleaning brush which enabled these problems to be substantially overcome. However, it has been found that particularly with the use of rolls with a fine textured finish or with fine grooves produced in final machining an even more effective cleaning action is required. The present invention provides an improved apparatus which enables better roll cleaning to be achieved.

DISCLOSURE OF THE INVENTION

According to the invention, there is provided apparatus for casting metal strip, comprising a casting roll, metal delivery means to deliver molten metal onto the surface of the casting roll, and a roll cleaning brush device to clean the roll surface, the cleaning brush device comprising a brush mounting structure, a series of rotary brush heads mounted on said structure in a linear array extending across the width of the casting roll and for rotation about respective individual brush head rotational axes which are transverse to the casting roll and are spaced across its width, and brush drive means to rotate the brush heads of the array.

Preferably, the apparatus further comprises means to move the cleaning device toward and away from the casting roll.

Preferably the brush mounting structure comprises an elongate member, the brush heads extend laterally outwardly to one side of that member with their rotary axes parallel to each other and spaced along the elongate member.

The brush heads may have generally circular outer ends defined by projecting bristles. The outer ends of the brushes may be of generally the same size as each other and the heads may be arranged with their rotary axes spaced at equal intervals along the array.

The brush heads may be carried on stub shafts rotatably mounted on the mounting structure and the brush drive means may comprise a drive shaft and coupling means to couple the brush stub shafts to the drive shaft.

More particularly, the coupling means may comprise a gear train providing direct coupling between successive stub shafts along the brush head array such that each successive pair of stub shafts and their associated brush heads are drivable in opposite rotational directions.

The gear train may comprise a series of intermeshing gears mounted one on each of the stub shafts and the drive shaft may be connected directly to one of those gears so as to be operable to drive that gear and through it all of the gears in the train.

The cleaning brush device may further comprises means to oscillate the array of brush heads generally linearally of the brush head array. In this case, the oscillation means may be such as to oscillate the array of brush heads through a stroke which is no less than the maximum gap between successive brush heads in the array so that in use of the apparatus the brush heads will sweep all of the roll surface to which the brush heads are applied.

In an alternative construction which avoids the need for oscillation of the brush heads, said linear array of brush heads may be one of a pair of parallel linear arrays of brush heads in which the brush heads of one array are staggered with respect to the brush heads of the other array.

Preferably, the brush heads are slidable along the stub shafts and there is biasing means to bias the brush heads outwardly along those shafts. The biasing means may comprise individual springs mounted one on each stub shaft to bias the respective brush heads outwardly along the shafts.

The apparatus may further comprise an elongate brush disposed to extend across the casting roll so as to engage that roll in advance of the roll cleaning device in the direction of rotation of that roll.

The casting roll may be one of a pair of casting rolls forming a hid between them, the metal delivery means may comprise a metal delivery nozzle for delivery of molten metal into the hid between the casting rolls, and the cleaning brush device may be one of a pair of such devices disposed to engage the rolls at locations spaced circumferentially of the rolls from the nip.

Specifically, the invention may provide apparatus for casting metal strip, comprising a pair of casting rolls forming a nip between them, a metal delivery nozzle for delivery of molten metal into the hid between the casting rolls to form a casting pool of molten metal in the nip, and a pair of roll cleaning brush devices disposed to engage the rolls at locations spaced circumferentially of the rolls from the nip, each cleaning brush device comprising a brush mounting structure, a series of rotary brush heads mounted on said structure in a linear array extending across the width of the respective roll to be cleaned and for rotation about respective individual brush head rotational axes which are transverse to roll to be cleaned and are spaced across its width, and brush drive means to rotate all the brush heads of the array simultaneously.

BRIEF DESCRIPTION OF THE DRAWINGS

In order that the invention may be more fully explained one particular embodiment will be described in some detail with reference to the accompanying drawings in which

FIG. 6 illustrates a preferred arrangement wherein the cleaning device is a pair of parallel linear arrays of brush heads.

DETAILED DESCRIPTION OF THE PREFERRED EMBODIMENT

Figure 1:
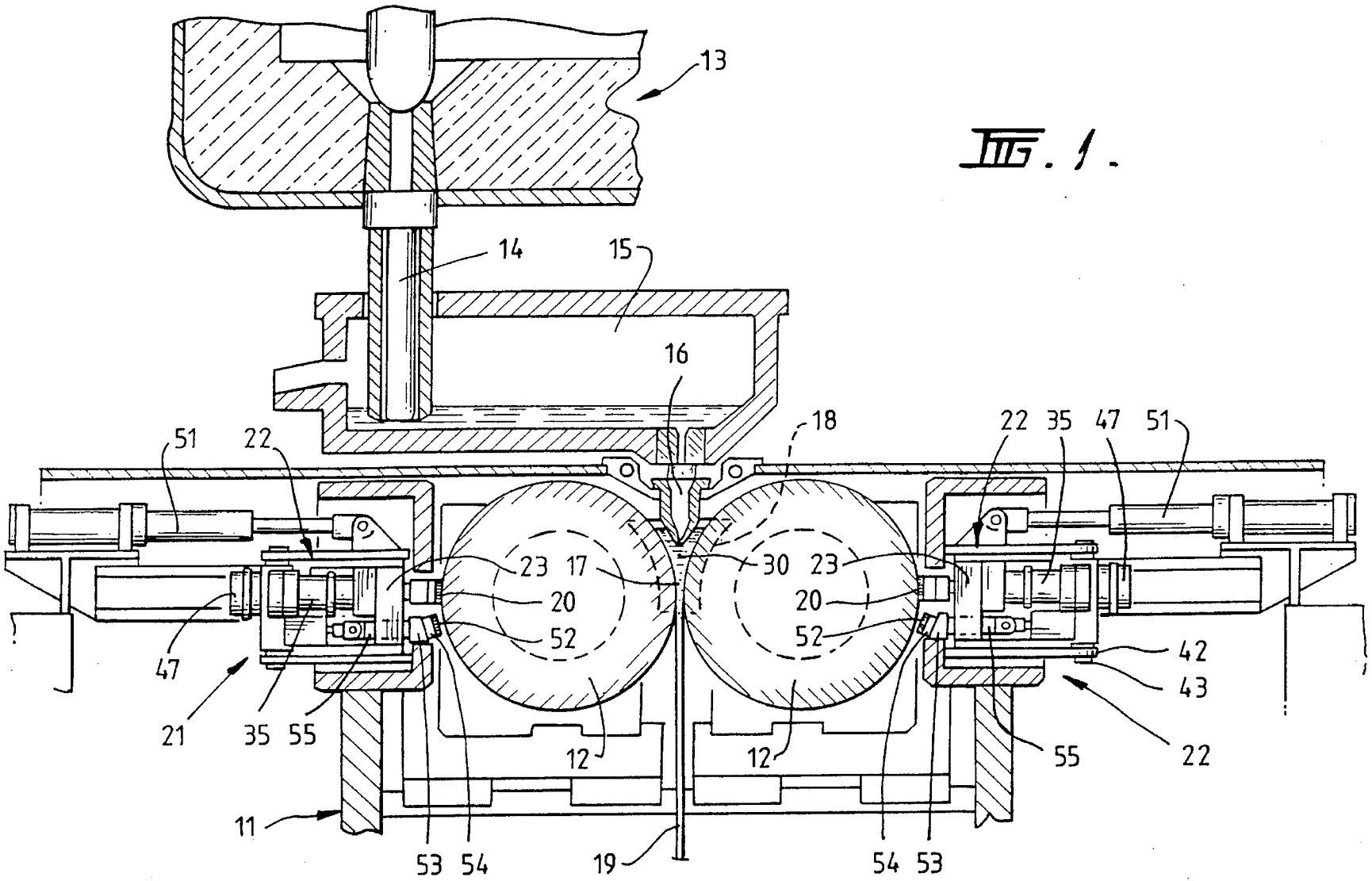
FIG. 1 illustrates a twin roll caster incorporating a pair of cleaning devices in accordance with the present invention.
Figure 2:
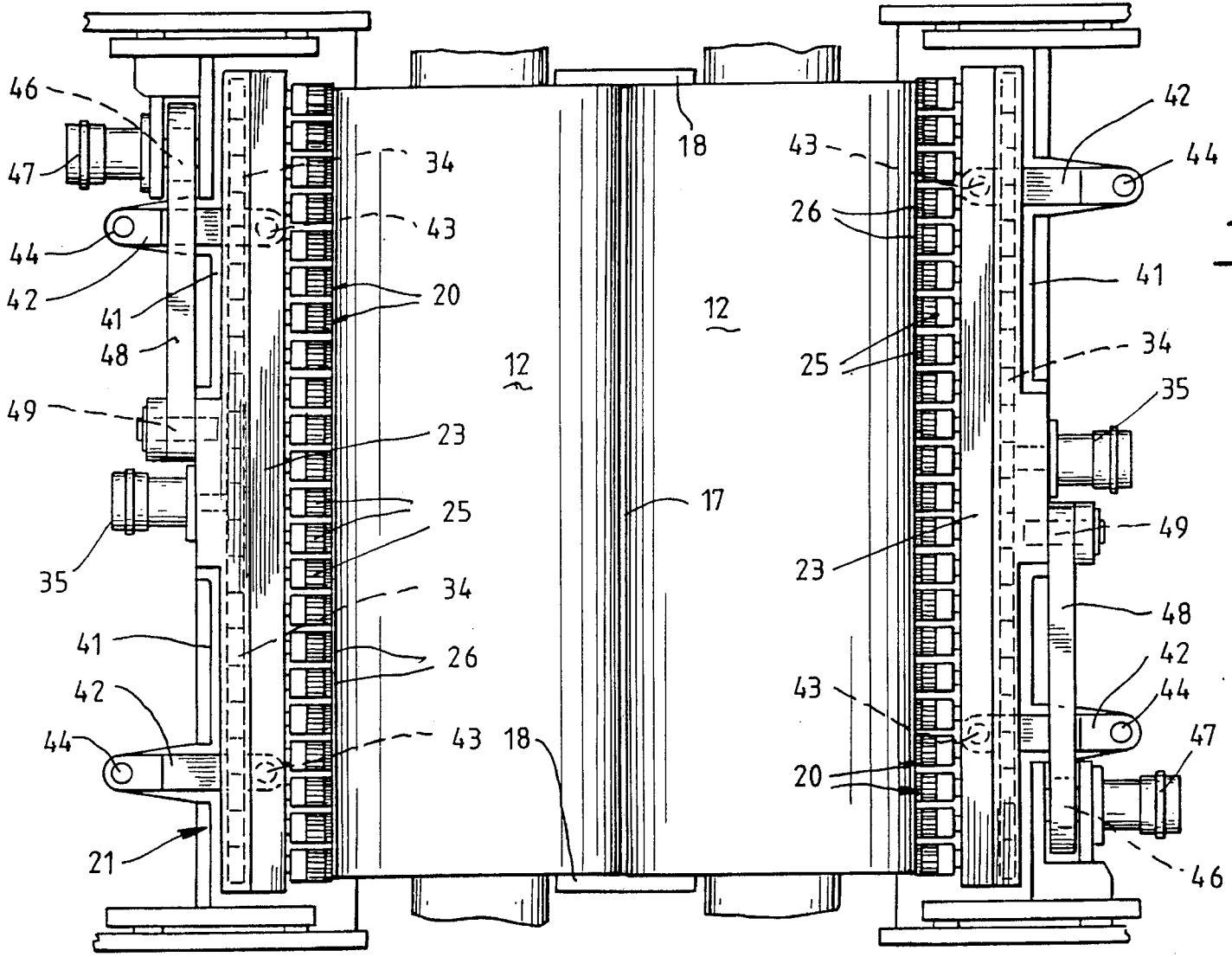
FIG. 2 is a plan view of essential parts of the caster illustrated in FIG. 1.
Figure 3:
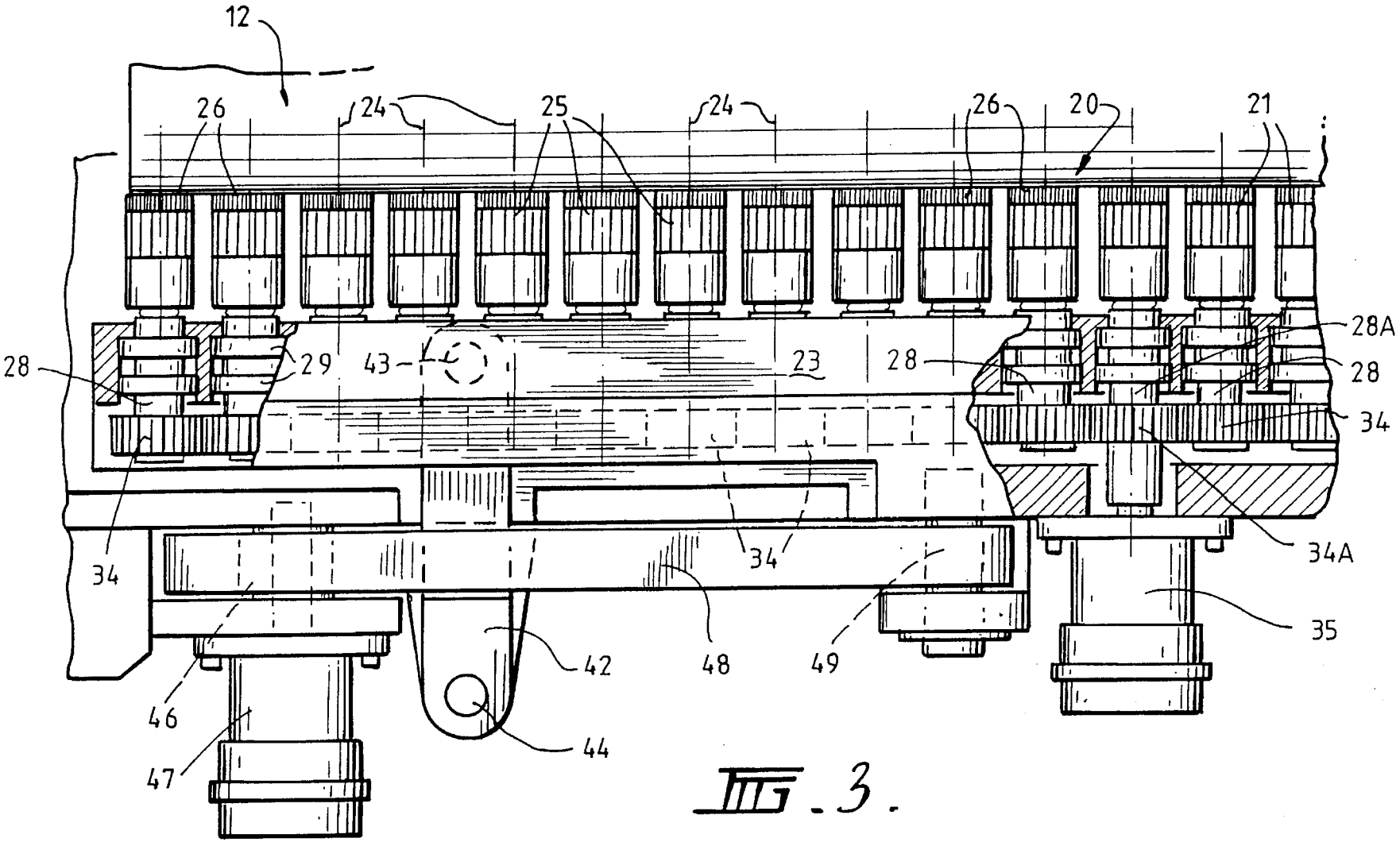
FIG. 3 is a plan view of part of one of the cleaning devices.
Figure 4:
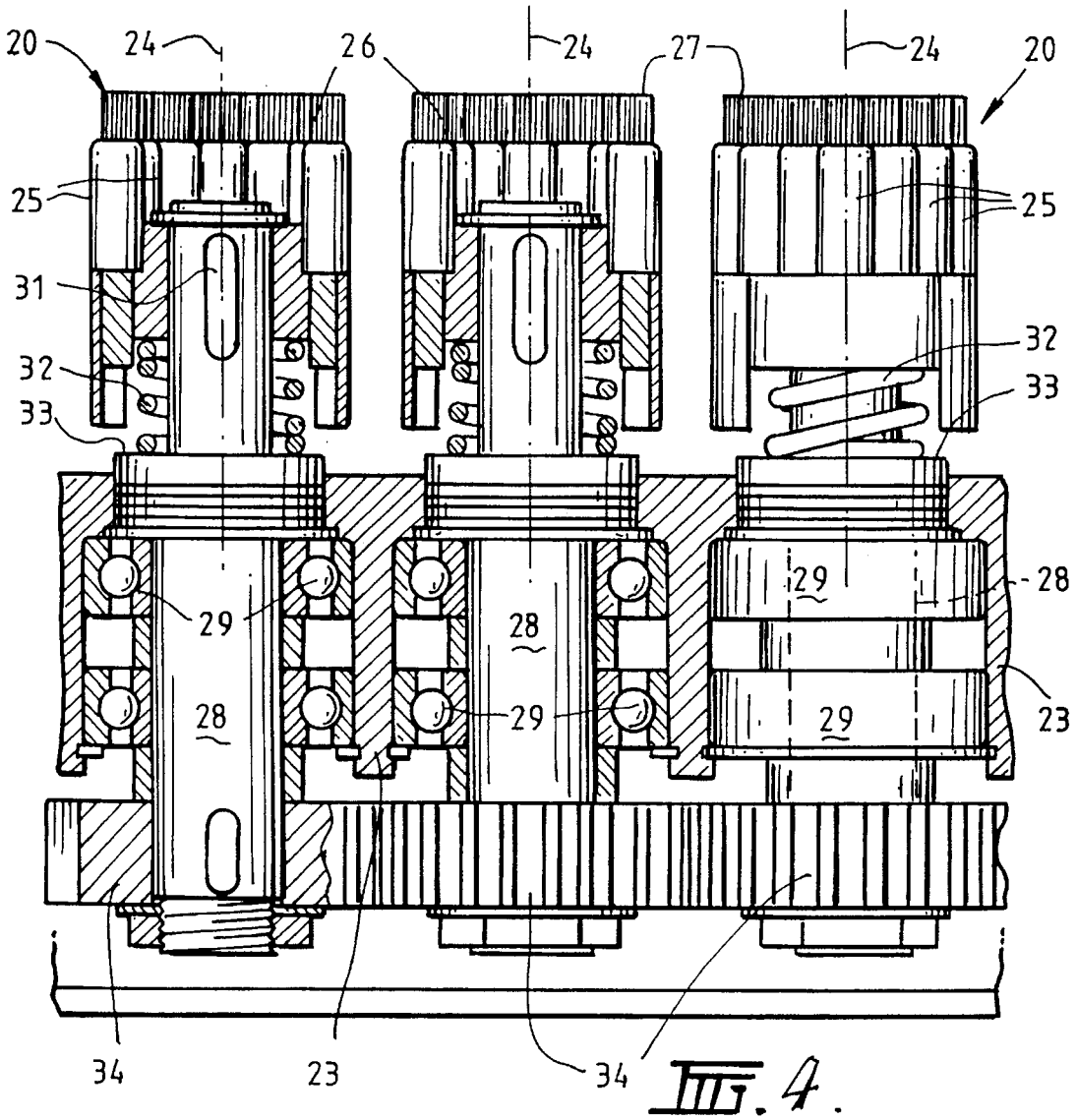
FIG. 4 illustrates further details of the cleaning device illustrated in FIG. 3.

The illustrated twin roll caster comprises a main machine frame 11 which supports a pair of parallel casting rolls 12. Molten metal is supplied during a casting operation from a ladle 13 through a refractory ladle outlet shroud 14 to a tundish 15 and thence through a metal delivery nozzle 16 into the nip 17 between the casting rolls 12. Hot metal thus delivered to the nip 17 forms a pool 30 above the nip and this pool is confined at the ends of the rolls by a pair of side closure plates 18 which are held against stepped ends of the rolls by actuation of a pair of hydraulic cylinder units (not shown). The upper surface of the pool 30 (generally referred to as the "meniscus" level) may rise above the lower end of the delivery nozzle so that the lower end of the delivery nozzle is immersed within this pool.

Casting rolls 12 are water cooled so that shells solidify on the moving roller surfaces and are brought together at the nip 17 between them to produce a solidified strip product 19 at the roll outlet. This product may be fed to a standard coiler (not shown).

The illustrated twin roll caster as thus far described is of the kind which is illustrated and described in some detail in our Australian Patent 631728 and our U.S. Pat. No. 5,184,668 and reference may be made to those patents for appropriate constructional details which form no part of the present invention.

In accordance with the present invention the illustrated twin roll caster is provided with a pair of roll cleaning devices denoted generally as 21 which are disposed on to each side of the pair of casting rolls such that they can be engaged with the outer side extremities of the rolls 12 to opposite sides of nip 17.

Each cleaning device 21 comprises a brush head mounting structure 22 which carries a linear array of rotary brush heads 20 to be applied to the outer side extremity of the roll to be cleaned. Mounting structure 22 comprises an elongate member 23 on which the brush heads are mounted to extend laterally outwardly to one side of that member with their rotary axes 24 parallel to each other and spaced along the elongate member 23.

The brush heads comprise cylindrical brush head bodies 25 in which are mounted tufts of outwardly projecting stiff bristles 26, which may for example be made of steel wire and which project outwardly to circular outer ends 27 of the brush heads 20. The brush heads are mounted on stub shafts 28 rotatably mounted by journal bearings 29 on the elongate member 23. The brush head bodies 25 are keyed by keys 31 to the shafts 28 so that they are rotatably coupled to the stub shafts but they are slidable along those shafts. Helical compression springs 32 are mounted on the stub shafts 28 and act between inner shoulders 33 on those shafts and the brush head bodies 25 to bias the brush heads outwardly along the stub shafts, the heads being held on the shafts by circlips.

The inner ends of stub shafts 28 carry spur gears 34 which intermesh with one another to form a gear train providing direct coupling between successive stub shafts along the brush head array such that each successive pair of stub shafts and their associated brush heads are drivable in opposite rotational directions by imparting a drive to the gear train. The drive is imparted from a central hydraulic drive motor 35 which is connected to the stub shaft 28A carrying a brush head generally in the middle of the array. Operation of drive motor 35 rotates the stub shaft 28A and therefore the central spur gear 34A attached to that shaft whereby all of the spur gears in the train are rotated to cause simultaneous rotation of all of the brush heads with successive brush heads along the array being driven in opposite rotational directions.

Elongate member 23 is mounted on a base member 41 of the brush head mounting structure 22 by means of a pair of links 42 which are pivotally connected at their outer ends to the member 23 by pivot pins 43 and are pivotally connected at their other ends to the base structure 41 by pivot pins 44. There is thus formed a parallelogram linkage which can be actuated to move elongate member 23 back and forth in the linear direction whereby to oscillate the array of brush heads generally linearally of the brush array. Such oscillation movement is generated by means of an eccentric bearing oscillator 46 driven by an oscillator motor 47 to move a tie-rod 48 connected between the oscillator and a pin 49 projecting from a mid-part of the elongate member 23. The movement of the oscillator is such as to move elongate member 23 back and forth through a stroke which is greater than each of the gaps between the successive brush heads so that the brush heads will sweep all of the roll surface to which they are applied.

The brush mounting structure 22 is connected to the rod ends of a pair of ram type cylinder units 51 disposed one to each end of that structure. The cylinder units 51 can be operated in unison to advance the brush mounting structure and with it the linear array of brushes toward the adjacent casting roll 12 so that the brush heads engage the roll surface. As the brush mounting structure is advanced the brush heads can retract by sliding along their stub shafts 28 against the loading provided by the helical compression springs 32. By adjusting the position of the brush mounting structure through appropriate actuation of the ram cylinder units 51 it is thus possible to vary the loading force with which the brush heads are biased against the casting roller, these biasing forces being dependent on the extent to which the springs 32 are compressed and the stiffness of those springs.

Each roll cleaning device also comprises an auxiliary or "scraper" brush 52 comprising an elongate brush head 53 with projecting bristles 54 extending across the respective roll 12 beneath the longitudinal array of rotary brush heads 20. This brush is mounted from the brush mounting structure 22 by means of pair of fluid cylinder units 55 actuable to advance and retract the brush relative to the mounting structure. Brush 53 serves to clean off major accretions of contaminants from the roll surface before the surface reaches the rotary brush heads which can then perform a fine cleaning function. The cylinder units 55 are operable independently of the cylinder units 51 controlling the rotary brushes so that the loading of the scraper brush can be adjusted independently of the loading of the rotary brushes. The scraper brush can also be brought into contact with the roll to be cleaned after the rotary brushes have been applied with appropriate spring loading.

In a typical twin roll caster the casting rolls may be of the order of 1300 mm wide and 500 mm in diameter. In the illustrated apparatus there are 22 rotary brush heads arranged at a pitch or spacing of 60 mm. Typically these may be 50 mm in diameter and contain 12 circumferentially spaced 6 mm diameter tufts of fine wire. The wire may for example be of about 0.1 mm diameter. The gaps between the circular ends of the rotary brushes may be around 12 mm and the stroke of the oscillatory movement may be about 15 mm so that all parts of the roll surface are engaged by the brush heads.

In another embodiment the bristles of adjacent tufts may be alternately coarse and fine. For example, alternate tufts may comprise steel wires of 0.15 mm diameter whereas intermediate tufts may be wires of 0.25 mm diameter. The bristles may project about 30 mm from the bases and be set about 15 mm into the bases.

In a further alternative embodiment, the tufts may be spaced in concentric circular rows with the tufts of one row being staggered relative to the tufts of an adjacent row. The bristles of the successive concentric rows of tufts may be alternately coarse and fine. For example, the tufts in the alternate rows may comprise steel wires of 0.15 mm diameter whereas the tufts in the intermediate rows may be wires of 0.25 mm diameter, the tufts of all rows being about 3 to 6 mm diameter at the base and being spaced apart by about 3 to 3.5 mm in both the longitudinal and transverse directions.

The biasing springs 28 may typically have a stiffness of 0.25 to 0.5 kg/mm. The springs may be preloaded so as to be compressed by about 5 mm before the brush heads make contact with the roll and may be compressed through about another 10 mm on application to the roll so as to produce a total spring displacement of the order of 15 mm. This will produce a loading force of about 4 kg on each rotary head. If there are say 22 rotary heads this will produce a reaction force on the mounting structure of the order of 88 kg.

The design of the apparatus is such as to permit variation of the rotary speed of the brush heads as well as the speed of the oscillatory motion. In a typical strip casting installation, the casting speed may be 30 meters to 60 meters per minute in which case the rotary speed of the brush heads may be of the order of 650 RPM and the brush heads may be oscillated at a rate of the order of 140 oscillations/minute.

Figure 5:
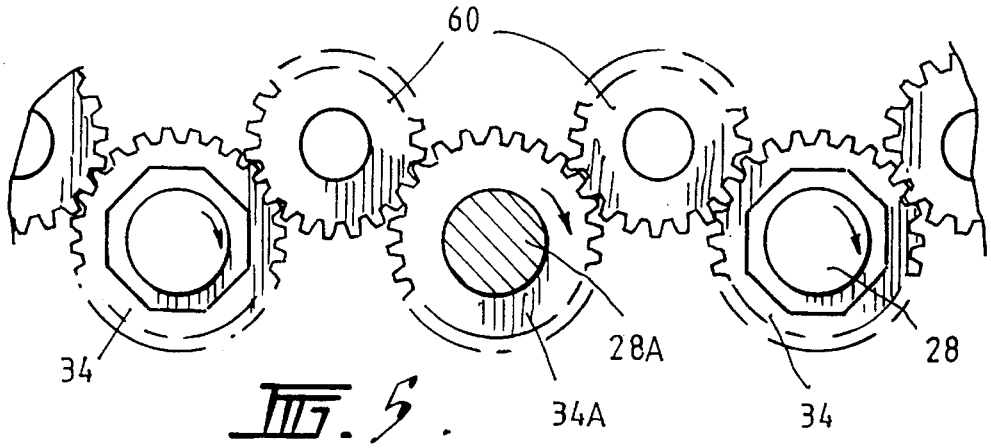
FIG. 5 illustrates a simple modification to a driving gear train incorporated in each of the cleaning devices.

FIG. 5 illustrates a simple modification to the gear train which drives the brush heads whereby the brush heads can all be driven in the same rotational directions. In this modification the stub shaft gears 34 are reduced in diameter so as not to engage one another directly and the gear train further comprises intermediate gears 60 providing couplings between the stub shaft gears 34 such that the stub shaft gears are all driven in the same directions of rotation. As before operations of the drive motor rotates the stub shaft 28A and therefore the central spur gear 34A whereby all of the gears in the train are rotated to cause simultaneous rotation of all the brush heads.

The illustrated cleaning apparatus has enabled much more effective cleaning of strip casting rolls than has been hitherto possible with known cleaning devices. The rotary action of the brush heads not only improves cleaning of the roll but it also contributes to self cleaning of the brush heads, since the rotary movement causes oxide flakes to be thrown clear of the brush heads rather than to be trapped against the roll and clogging the brush bristles. The ability to alter the operating parameters of the brush assembly is a very significant advantage and enables optimum operating conditions to be achieved by appropriate trial and adjustment. However, this particular construction has been advanced by way of example and it could be modified considerably. For example, instead of having a single linear array of brush heads 20, each cleaning device 21 may carry two parallel linear arrays of brush heads with the brush heads of one array staggered in the longitudinal direction with respect to the brush heads of the other array. Such an arrangement is illustrated in FIG. 6 which show a casting roll 12 in contact with a pair of parallel linear arrays of brush heads 20*a*, 20*b* shown in cross-section. The brush heads 20*b* are staggered in relation to the brush heads 20*a*. With this arrangement it is possible to have the brush heads of one array to overlap the brush heads of the other array to avoid the need for oscillation of the brush heads. Moreover, the invention is not limited to the cleaning of rolls in a twin roll caster and it may equally be applied to a single roll caster. It is accordingly to be understood that the invention is no way limited to the particular applications and the constructional details of the illustrated construction and that many modifications and variations will fall within the scope of the appended claims.

I claim:

1. Apparatus for casting metal strip, comprising a casting roll, metal delivery means to deliver molten metal onto the surface of the casting roll, and a roll cleaning brush device to clean the roll surface, the cleaning brush device comprising a brush mounting structure, a series of rotary brush heads mounted on said structure in a linear array extending across the width of the casting roll and for rotation about respective individual brush head rotational axes which are transverse to a casting surface of the roll and are spaced across said width, and brush drive means to rotate the brush heads of the array.

2. Apparatus as claimed in claim 1, wherein the apparatus further comprises means to move the cleaning device toward and away from the casting roll.

3. Apparatus as claimed in claim 1, wherein the brush mounting structure comprises an elongate member, the brush heads extend laterally outwardly to one side of that member with their rotary axes parallel to each other and spaced along the elongate member.

4. Apparatus as claimed in claim 3, wherein the brush heads have generally circular outer ends defined by projecting bristles.

5. Apparatus as claimed in claim 4, wherein the outer ends of the brushes are of generally the same size as each other and the heads are arranged with their rotary axes spaced at equal intervals along the array.

6. Apparatus as claimed in claim 1, wherein the brush heads are carried on stub shafts rotatably mounted on the mounting structure and the brush drive means comprises a drive shaft and coupling means to couple the brush stub shafts to the drive shaft.

7. Apparatus as claimed in claim 6, wherein the coupling means comprises a gear train providing direct coupling between successive stub shafts along the brush head array such that each successive pair of stub shafts and their associated brush heads are drivable in opposite rotational directions.

8. Apparatus as claimed in claim 7, wherein the gear train comprises a series of intermeshing gears mounted one on each of the stub shafts and the drive shaft is connected directly to one of those gears so as to be operable to drive that gear and through it all of the gears in the train.

9. Apparatus as claimed in claim 6, wherein the coupling means comprises a gear train providing a coupling between the stub shafts such that the stub shafts and their associated brush heads are all rotated in the same rotational directions.

10. Apparatus as claimed in claim 9, wherein the gear train comprises a series of gears mounted one on each of the stub shafts and intermediate gears providing couplings between the stub shaft gears and the drive shaft is connected directly to one of the gears of the gear train so as to drive that gear and through it all of the gears in the train.

11. Apparatus as claimed in claim 6, wherein the brush heads are slidable along the stub shafts and there is biasing means to bias the brush heads outwardly along those shafts.

12. Apparatus as claimed in claim 11, wherein the biasing means comprises individual springs mounted one on each stub shaft to bias the respective brush heads outwardly along the shafts.

13. Apparatus as claimed in claim 1, wherein the cleaning brush device further comprises means to oscillate the array of brush heads generally linearly of the brush head array.

14. Apparatus as claimed in claim 13, wherein the oscillation means is such as to oscillate the array of brush head through a stroke which is no less than the maximum gap between successive brush heads in the array so that in use of the apparatus the brush heads will sweep all of the roll surface to which the brush heads are applied.

15. Apparatus as claimed in claim 1, wherein said linear array of brush heads is one of a pair of parallel linear arrays of brush heads in which the brush heads of one array are staggered with respect to the brush heads of the other array.

16. Apparatus as claimed in claim 1 and further comprising an elongate brush disposed to extend across the casting roll so as to engage that roll in advance of the roll cleaning device in the direction of rotation of that roll.

17. Apparatus as claimed in claim 1, wherein the casting roll is one of a pair of casting rolls forming a nip between them, the metal delivery means comprises a metal delivery nozzle for delivery of molten metal into the nip between the casting rolls, and the cleaning brush device is one of a pair of such devices disposed to engage the rolls at locations spaced circumferentially of the rolls from the nip.

18. Apparatus for casting metal strip, comprising a pair of casting rolls forming a nip between them, a metal delivery nozzle for delivery of molten metal into the nip between the casting rolls to form a casting pool of molten metal in the nip, and a pair of roll cleaning brush devices disposed to engage the rolls at locations spaced circumferentially of the rolls from the nip, each cleaning brush device comprising a brush mounting structure, a series of rotary brush heads mounted on said structure in a linear array extending across the width of the respective roll to be cleaned and for rotation about respective individual brush head rotational axes which are transverse to a casting surface of the respective roll to be cleaned and are spaced across said width, and brush drive means to rotate all the brush heads of the array simultaneously.

* * * * *

UNITED STATES PATENT AND TRADEMARK OFFICE

CERTIFICATE OF CORRECTION

PATENT NO. : 5,575,327

DATED : November 19, 1996

INVENTOR(S) : KATO

It is certified that error appears in the above-indentified patent and that said Letters Patent is hereby corrected as shown below:

On the title page:

Item [73], line 2, insert -- Tokyo, Japan; --

Item [73], line 3, delete "both of Japan" insert therefor -- Melbourne, Australia --.

Signed and Sealed this

Nineteenth Day of August, 1997

*Attest:*

*Attesting Officer*

Bruce Lehman

BRUCE LEHMAN

*Commissioner of Patents and Trademarks*